US008159480B2

(12) United States Patent
Tajiri

(10) Patent No.: US 8,159,480 B2
(45) Date of Patent: Apr. 17, 2012

(54) ELECTRO-OPTICAL DEVICE AND ELECTRONIC APPARATUS

(75) Inventor: Kenichi Tajiri, Nagano (JP)

(73) Assignee: Sony Corporation, Tokyo (JP)

( * ) Notice: Subject to any disclaimer, the term of this patent is extended or adjusted under 35 U.S.C. 154(b) by 1278 days.

(21) Appl. No.: 11/836,525

(22) Filed: Aug. 9, 2007

(65) Prior Publication Data

US 2008/0036786 A1 Feb. 14, 2008

(30) Foreign Application Priority Data

Aug. 9, 2006 (JP) ..... 2006-216511

(51) Int. Cl.
*G09G 5/00* (2006.01)

(52) U.S. Cl. ..... 345/204

(58) Field of Classification Search ..... None
See application file for complete search history.

(56) References Cited

U.S. PATENT DOCUMENTS

| | | | | |
|---|---|---|---|---|
| 5,552,800 | A * | 9/1996 | Uchikoga et al. | 345/89 |
| 6,396,465 | B1 * | 5/2002 | Nakagiri | 345/69 |
| 2004/0257325 | A1 * | 12/2004 | Inoue | 345/89 |

FOREIGN PATENT DOCUMENTS

| | | | |
|---|---|---|---|
| CN | 1573903 | A | 2/2005 |
| JP | 05-341734 | A | 12/1993 |
| JP | 06-214214 | | 8/1994 |
| JP | 06301010 | | 10/1994 |
| JP | 07261155 | | 10/1995 |
| JP | 08-211407 | A | 8/1996 |
| JP | 09127530 | | 5/1997 |
| JP | 2002-040994 | A | 2/2002 |
| JP | 2003143556 | | 5/2003 |
| JP | 2004062146 | | 2/2004 |

OTHER PUBLICATIONS

Japanese Patent Office, Office Action issued in connection with Japanese Patent Application No. 2008-257146, mailed on Nov. 8, 2011. (3 pages).

* cited by examiner

*Primary Examiner* — Richard Hjerpe
*Assistant Examiner* — Carolyn R Edwards
(74) *Attorney, Agent, or Firm* — K&L Gates LLP

(57) ABSTRACT

An electro-optical device includes a plurality of scanning lines and a plurality of data lines, pixels arranged so as to correspond to intersections of the plurality of scanning lines and the plurality of data lines, and an electro-optical material in which a response speed at a time of halftone display is lower than those at a time of low-gray-scale-level display and at a time of high-gray-scale-level display. Each of the pixels includes at least two adjacent subpixels as a group. Each of the subpixels includes a pixel electrode, a common electrode arranged so as to face the pixel electrode, and a switching device which electrically connects a corresponding one of the data lines to the pixel electrode in accordance with a selection voltage supplied from a corresponding one of the scanning lines. The switching device is connected to the corresponding one of the scanning lines.

5 Claims, 8 Drawing Sheets

FIG. 1

UNIT: msec

| DATA BEFORE GRAY-SCALE LEVEL IS CHANGED | DATA AFTER GRAY-SCALE LEVEL IS CHANGED | | | | |
|---|---|---|---|---|---|
| GRAY SCALE | 0 | 64 | 128 | 192 | 255 |
| 0 | | 81 | 59 | 44 | 24 |
| 46 | 9 | | 27 | 24 | 14 |
| 128 | 9 | 31 | | 22 | 13 |
| 192 | 10 | 28 | 26 | | 11 |
| 255 | 12 | 29 | 26 | 23 | |

ELECTRO-OPTICAL DEVICE AND ELECTRONIC APPARATUS

RELATED APPLICATIONS

The present application is based on, and claims priority from, Japan Application Number 2006-216511, filed Aug. 9, 2006, the disclosure of which is hereby incorporated by reference herein in its entirety.

BACKGROUND

1. Technical Field

The present invention relates to electro-optical devices, such as liquid crystal display devices, and electronic apparatuses.

2. Related Art

In general, an active matrix liquid crystal display device is well known as an example of an electro-optical device. The active matrix liquid crystal display device includes a plurality of scanning lines and common lines, a plurality of data lines which perpendicularly intersect the plurality of scanning lines and common lines, a first substrate having a plurality of pixel circuits arranged thereon so as to correspond to intersections of the scanning lines and the data lines, a second substrate arranged so as to face the first substrate, and a layer of liquid crystal which is an electro-optical material arranged between the first substrate and the second substrate.

The liquid crystal display device further includes a scanning line driving circuit which drives the scanning lines and a data line driving circuit which drives the data lines.

Examples of methods of driving liquid crystal include a TN (twisted nematic) method, a VA (vertical alignment) method, and an IPS (in-place-switching) method.

Here, the VA method will be described with reference to FIGS. 8A to 8C. In the VA method, when a voltage is not applied, liquid crystal molecules are aligned substantially upright with respect to the horizontal direction whereby light emitted from a backlight arranged on a back side is blocked and black display is attained (FIG. 8C). When a voltage having a predetermined value (an intermediate value) is applied, the liquid crystal molecules are aligned so as to be at a predetermined angle with respect to the horizontal direction whereby part of the light emitted from the backlight arranged on the back side is transmitted (FIG. 8B). When a maximum voltage is applied, the liquid crystal molecules are flatly aligned with respect to the horizontal direction whereby the light emitted from the backlight arranged on the back side is entirely transmitted and white display is attained (FIG. 8A).

Furthermore, in the VA method, when a voltage is not applied, since the light emitted from the backlight is not influenced from the liquid crystal molecules and is substantially blocked by a polarizing plate, pure black display is attained when compared with the TN method, and furthermore, a high contrast ratio is attained.

Furthermore, in the VA method, when compared with a response speed in a rise time (a change from black display to white display) and a response speed in a fall time (a change from white display to black display), a response speed when a halftone is displayed is intend to be low. To improve the response speed when a halftone is displayed, in general, overdrive processing is performed (for example, refer to JP-A-2003-143556).

Here, the overdrive processing will be described. The liquid crystal display device detects gray-scale data from an input image signal and supplies the detected gray-scale data to a correction circuit and a memory. The memory stores the gray-scale data for a period of one frame and outputs the gray-scale data to the correction circuit.

The correction circuit compares gray-scale data in a preceding frame with gray-scale data in a succeeding frame, corrects the gray-scale data in the succeeding frame in accordance with a result of the comparison, and applies a voltage to a liquid crystal panel in accordance with the correction. Accordingly, the response speed when halftone is displayed is improved by applying a large voltage to the liquid crystal panel.

However, for such overdrive processing, a memory is required for temporarily storing the gray-scale data in the preceding frame. Therefore, when a liquid crystal display device including a driving processing unit which is not provided with a memory such as a RAM (random access memory) is used, a memory dedicated to the overdrive processing is required to be provided. Accordingly, an area of a substrate for implementing the memory becomes large resulting in increased cost.

Furthermore, in the overdrive processing, an electric power is required for comparison and calculation of the gray-scale data in the preceding frame and the gray-scale data in the succeeding frame.

SUMMARY

An advantage of some aspects of the invention is to provide an electro-optical device capable of improving a response speed of liquid crystal without performing overdrive processing and an electronic apparatus.

In accordance with an embodiment of the invention, there is provided an electro-optical device including: a plurality of scanning lines and a plurality of data lines; pixels arranged so as to correspond to intersections of the plurality of scanning lines and the plurality of data lines; and an electro-optical material in which a response speed at a time of halftone display is lower than those at a time of low-gray-scale-level display and at a time of high-gray-scale-level display. Each of the pixels includes at least two adjacent subpixels as a group. Each of the subpixels includes a pixel electrode, a common electrode arranged so as to face the pixel electrode, and a switching device which electrically connects a corresponding one of the data lines to the pixel electrode in accordance with a selection voltage supplied from a corresponding one of the scanning lines. The switching device is connected to the corresponding one of the scanning lines.

Accordingly, since the electro-optical device according to the embodiment of the invention causes each of the pixels to perform display using a pair of subpixels, halftone display is achieved without performing overdrive processing. Consequently, since a memory necessary for the overdrive processing can be eliminated, a size of the entire device and production cost thereof can be reduced, and a response speed of the liquid crystal can be improved. Furthermore, the amount of electric power required for the overdrive processing can be reduced.

The electro-optical device may further include: a gray-scale-level detection unit that detects a gray-scale level of image data externally supplied; a determination unit that determines whether the gray-scale level detected using the gray-scale-level detection unit is within a range considered to be a halftone; a scanning line driving circuit that generates the selection voltage used for sequentially selecting the plurality of scanning lines in a predetermined order in accordance with a result of the determination made using the determination unit, and supplies the selection voltage to the corresponding one of the scanning lines; and a data line driving circuit that generates a certain image signal from the image data in accordance with the result of the determination made using the determination unit, and supplies the generated image signal to the corresponding one of the data lines. When the determination unit determines that the gray-scale level is within the range considered to be a halftone, the scanning line driving circuit generates the selection voltage used for sequentially selecting the plurality of scanning lines each of which is connected to a corresponding switching device in one horizontal scanning period, and supplies the generated selection voltage to the corresponding one of the scanning line, and the data line driving circuit generates an image signal used for low-gray-scale-level display and an image signal used for high-gray-scale-level display so that halftone display is entirely achieved in each of the pixels, and supplies the generated image signals to the corresponding data lines at a predetermined timing.

Accordingly, in a case where it is determined that a gray-scale level in a preceding frame is within a predetermined range considered to be a halftone, an image signal to be supplied to a corresponding one of the scanning lines is modulated and the modulated image signal is supplied to the corresponding one of the scanning lines so that halftone display is entirely achieved in each of the pixels which is constituted by a pair of subpixels. Consequently, since a response speed is improved using pulse-surface-area modulation instead of overdrive processing, a memory necessary for the overdrive processing can be eliminated, and a size of the entire device and production cost thereof can be reduced. Furthermore, the amount of electric power required for the overdrive processing can be reduced.

In accordance with another embodiment of the invention, there is provided an electro-optical device including: a plurality of scanning lines and a plurality of data lines; pixels arranged so as to correspond to intersections of the plurality of scanning lines and the plurality of data lines; and an electro-optical material in which a response speed at a time of changing to halftone display is lower than those at a time of changing to low-gray-scale-level display and at a time of changing to high-gray-scale-level display. Each of the pixels includes a pair of a first subpixel and a second subpixel arranged adjacent to each other. The first subpixel includes a first pixel electrode, a common electrode arranged so as to face the first pixel electrode, and a first switching device which electrically connects the corresponding one of the data lines to the first pixel electrode in accordance with a selection voltage supplied from the corresponding one of the scanning lines. The second subpixel includes a second pixel electrode, the common electrode arranged so as to face the second pixel electrode, a second switching device which is connected to the first pixel electrode and the second pixel electrode, and a third switching device which is connected to the common electrode and the second pixel electrode. The second switching device and the third switching device are commonly connected to a control line so as to be switched between an on-state and an off-state.

Accordingly, since the electro-optical device according to the embodiment of the invention causes each of the pixels to perform display using the first subpixel and the second subpixel, halftone display is achieved without performing overdrive processing. Accordingly, since a memory necessary for the overdrive processing can be eliminated, a size of the entire device and production cost thereof can be reduced, and a response speed of the liquid crystal can be improved. Furthermore, the amount of electric power required for the overdrive processing can be reduced.

The electro-optical device may further include: a gray-scale-level detection unit that detects a gray-scale level of image data externally supplied; a determination unit that determines whether the gray-scale level detected using the gray-scale-level detection unit is within a range considered to be a halftone; a scanning line driving circuit that generates the selection voltage used for sequentially selecting the plurality of scanning lines in a predetermined order, and supplies the selection voltage to the corresponding one of the scanning lines; a data line driving circuit that generates a certain image signal from the image data in accordance with a result of the determination made using the determination unit, and supplies the generated image signal to the corresponding one of the data lines; and a switching unit that turns off the second switching device and turns on the third switching device in one horizontal scanning period when the determination unit determines that the gray-scale level is within the range considered to be a halftone, and that turns on the second switching device and turns off the third switching device in one horizontal scanning period when the determination unit determines that the gray-scale level is out of the range considered to be a halftone. When the switching unit turns off the second switching device and turns on the third switching device, the data line driving circuit may supply an image signal for low-gray-scale-level display to one of the first subpixel and the second subpixel and may supply an image signal for high-gray-scale-level display to the other one of the first subpixel and the second subpixel through the corresponding data lines so that halftone display is entirely achieved in each of the pixels including the first subpixel and the second subpixel.

Accordingly, in a case where it is determined that a gray-scale level in a preceding frame is within a predetermined range considered to be a halftone, the second switching device is turned off and the third switching device is turned on and further an image signal having a low-gray-scale level is supplied to one of the first subpixel and the second subpixel and an image signal having a high-gray-scale level is supplied to the other one of the first subpixel and the second subpixel so that halftone display is entirely achieved in each of the pixels. Consequently, since a response speed is improved using pulse-surface-area modulation instead of overdrive processing, a memory necessary for the overdrive processing can be eliminated, and a size of the entire device and production cost thereof can be reduced. Furthermore, the amount of electric power required for the overdrive processing can be reduced.

An electronic apparatus according to a further embodiment of the invention includes the electro-optical device described above.

BRIEF DESCRIPTION OF THE DRAWINGS

The invention will be described with reference to the accompanying drawings, wherein like numbers reference like elements.

FIG. 1 shows a table illustrating the relationship between a gray-scale level and a response time of liquid crystal.

DESCRIPTION OF EXEMPLARY EMBODIMENTS

Figure 2:
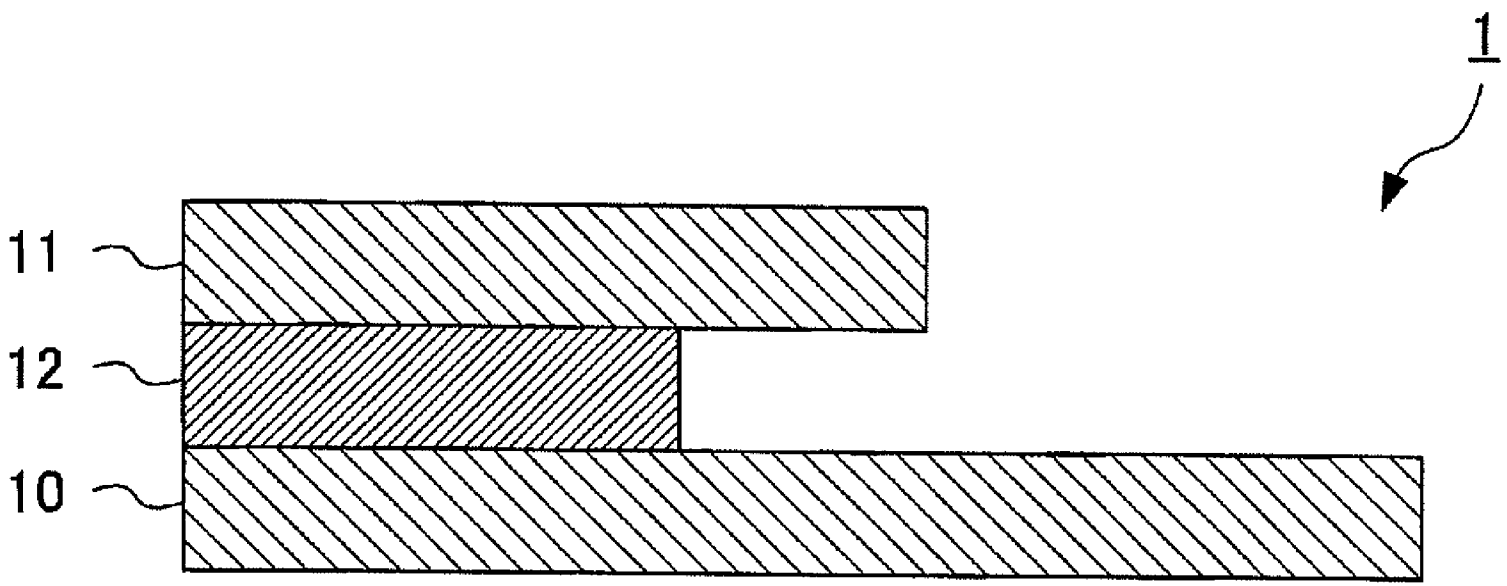
FIG. 2 shows a sectional view illustrating an electro-optical device according to an embodiment of the present invention.

Embodiments of the present invention will be described hereinafter with reference to accompanying drawings. Note that in descriptions of the embodiments and modifications described hereinafter, the same reference numerals are used for the same components and descriptions thereof are omitted or simplified.

FIG. 1 shows a table illustrating the relationship between a gray-scale level and a response time of liquid crystal. In a case where a gray-scale level of an image signal in a preceding frame is "0" and a gray-scale level of an image signal in a succeeding frame is "64", a response time of liquid crystal is 81 msec. Similarly, in a case where the gray-scale level of the image signal in the preceding frame is "0" and the gray-scale level of the image signal in the succeeding frame is "128", "192", or "255", the response time of liquid crystal is 59 msec, 44 msec, or 24 msec, respectively. Similarly, as shown in FIG. 1, in a case where the gray-scale level of the image signal in the preceding frame is "64", "128", "192", or "255", a response time is determined in accordance with the gray-scale level in the succeeding frame.

As is apparent from FIG. 1, when compared with a response speed in a case where a gray-scale level is changed from a low level to a high level and a response speed in a case where a gray-scale level is changed from a high level to a low level, a response speed in a case where a gray-scale level is changed from a low level to a halftone and a response speed in a case where a gray-scale level is changed from a high level to a halftone take more time.

According to the embodiments of the invention, in a case where a gray-scale level is changed to a halftone, a response speed of liquid crystal is improved by performing pulse-surface-area modulation using divided pixels without performing overdrive processing.

First Embodiment

FIG. 2 shows a sectional view illustrating an electro-optical device 1 according to the invention. The electro-optical device 1 employs, for example, an MVA (multi domain vertical alignment) method. As shown in FIG. 2, the electro-optical device 1 includes a first substrate 10 and a second substrate 11, and an electro-optical material 12. The first substrate 10 includes pixel electrodes arranged thereon so as to correspond to intersections of a plurality of scanning lines Y and a plurality of data lines X. The second substrate 11 includes common electrodes arranged thereon so as to face the pixel electrodes. The electro-optical material 12 is arranged between the first substrate 10 and the second substrate 11.

Figure 3:
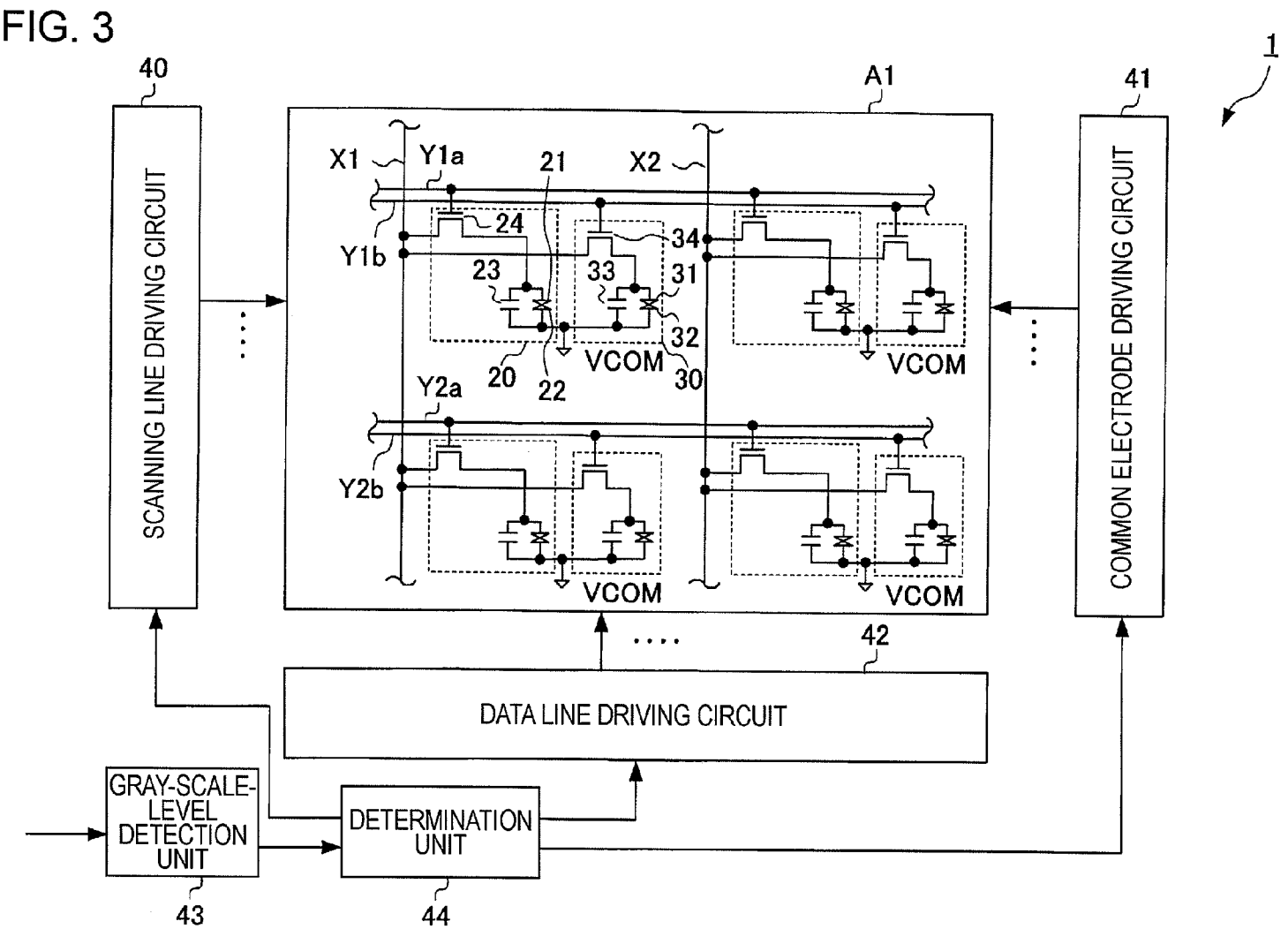
FIG. 3 shows a block diagram illustrating an example of a first configuration of the electro-optical device according to the embodiment of the invention.

As shown in FIG. 3, the electro-optical device 1 includes a pixel unit A1, a scanning line driving circuit 40, common electrodes 22 and 32, a common electrode driving circuit 41, a data line driving circuit 42, a gray-scale-level detection unit 43, and a determination unit 44. The pixel unit A1 is a display area including a plurality of pixels. The scanning line driving circuit 40 selectively drives the plurality of scanning lines Y in a predetermined order. The common electrode driving circuit 41 supplies voltages to be applied to the common electrodes 22 and 32. The data line driving circuit 42 supplies image signals to the data lines X when one of the scanning lines Y is selected. The gray-scale-level detection unit 43 detects a gray-scale level of each of the image signal. The determination unit 44 determines whether the gray-scale level detected using the gray-scale-level detection unit 43 is within a range considered to be a halftone. The electro-optical device 1 further includes a backlight unit, not shown, which illuminates the pixel unit A1 from the back side thereof. Note that only a portion (four pixels) of the pixel unit A1 is shown in FIG. 3. Furthermore, the determination unit 44 also functions as a timing controller.

Here, a configuration of the pixel unit A1 will be described in detail. Note that each of the pixels according to the embodiment of the invention includes at least two adjacent subpixels as a group. Description will be made hereinafter for each of the pixels including two subpixels, that is, a first subpixel 20 and a second subpixel 30.

The first subpixel 20 includes, as shown in FIG. 3, a pixel electrode 21, a common electrode 22 arranged so as to face the pixel electrode 21, a storage capacitor 23, and a switching device 24 (for example, a TFT (thin-film transistor)) used for electrically connecting the pixel electrode 21 to a corresponding one of the data lines X in accordance with a selection voltage supplied from a corresponding one of the scanning lines Y. Note that in this embodiment, although a TFT is taken as an example of the switching device, the invention is not limited to this. A TFD (thin-film diode) may be used as the switching device. The combination of the pixel electrode 21 and the common electrode 22 configures a pixel capacitor.

The switching device 24 is connected to the pixel electrode 21 through a first terminal (a source terminal or a drain terminal), is connected to a scanning line Y1*a* through a second terminal (a gate terminal), and is connected to a data line X1 through a third terminal (a drain terminal or a source terminal).

The second subpixel 30 includes, as shown in FIG. 3, a pixel electrode 31, a common electrode 32 arranged so as to face the pixel electrode 31, a storage capacitor 33, and a switching device 34 used for electrically connecting the pixel electrode 31 to corresponding one of the data lines X in accordance with a selection voltage supplied from corresponding one of the scanning lines Y. The combination of the pixel electrode 31 and the common electrode 32 configures a pixel capacitor. Note that the common electrode 22 and the common electrode 32 are integrally configured.

The switching device 34 is connected to the pixel electrode 31 through a first terminal (a source terminal or a drain terminal), is connected to a scanning line Y1*b* through a second terminal (a gate terminal), and is connected to the data line X1 through a third terminal (a drain terminal or a source terminal) similarly to the third terminal of the switching device 24.

Accordingly, for example, in one horizontal scanning period, switching between the scanning lines Y from one to another is selectively performed so that low-gray-scale-level display is achieved using the first subpixel 20 and high-gray-scale-level display is achieved using the second subpixel 30 whereby pulse-surface-area modulation is performed and halftone display is achieved.

Furthermore, in the electro-optical device 1 according to this embodiment of the invention, at least two subpixels are included in a group, and the scanning lines Y1*a* and Y1*b* which correspond to the subpixels and between which switching is successively performed in one horizontal scanning period are set as a pair of scanning lines. In this condition, switching between the scanning line Y1*a* and the scanning line Y1*b* is performed every horizontal scanning period.

The scanning line driving circuit 40 supplies selection voltages successively to the scanning lines Y so that the switching device 24 or the switching device 34 is brought into a conduction state.

The common electrode driving circuit 41 supplies a first voltage and a second voltage which has a potential higher than that of the first voltage to the common electrodes 22 and 32 alternately every one horizontal period.

The data line driving circuit 42 supplies image signals to the data lines X. By this, an image voltage is supplied to the pixel electrode 21 or 31 in accordance with one of the image signals through the switching device 24 or 34 which is in an on-state.

Here, the data line driving circuit 42 performs positive-polarity writing in which image signals which have potentials higher than those of the common electrodes 22 and 32 are supplied to the data lines X and image voltages generated on the basis of the image signals having the positive polarities are written to the pixel electrodes 21 and 31, and performs negative-polarity writing in which image signals which have potentials lower than those of the common electrodes 22 and 32 are supplied to the data lines X and image voltages generated on the basis of the image signals having the negative polarities are written to the pixel electrodes 21 and 31. The positive-polarity writing and the negative-polarity writing are alternately performed every horizontal scanning line.

The gray-scale-level detection unit 43 detects gray-scale levels of input image signals and supplies results of the detection to the determination unit 44. Note that in this embodiment, although the gray-scale-level detection unit 43 detects gray-scale levels of the image signals in 256 gray-scale levels, the present invention is not limited to this.

The determination unit 44 determines, for each of the gray-scale levels of the image signals supplied from the gray-scale-level detection unit 43, whether the gray-scale level is within a predetermined range (for example, a range from 64 to 128) considered to be a halftone. When the determination is affirmative, the determination unit 44 controls the scanning line driving circuit 40 and the data line driving circuit 42 as needed to display an image using pulse-surface-area modulation. On the other hand, when the determination is negative, since it is not necessary to perform the pulse-surface-area modulation, the determination unit 44 controls the scanning line driving circuit 40 and the data line driving circuit 42 as needed so that normal gray-scale display is performed.

Here, operations of the scanning line driving circuit 40 and the data line driving circuit 42 performed in a case where it is determined that a gray-scale level, which is detected using the gray-scale-level detection unit 43 which is controlled by the determination unit 44, is within a range considered to be a halftone will be described with reference to FIG. 4. Note that FIG. 4 shows a waveform chart illustrating a timing of selecting the scanning line Y1*a*, a timing of selecting the scanning line Y1*b*, a timing of outputting data to be supplied to one of the data lines X, and a timing of switching a voltage to be applied to the common electrode 22 or 32.

Figure 4:
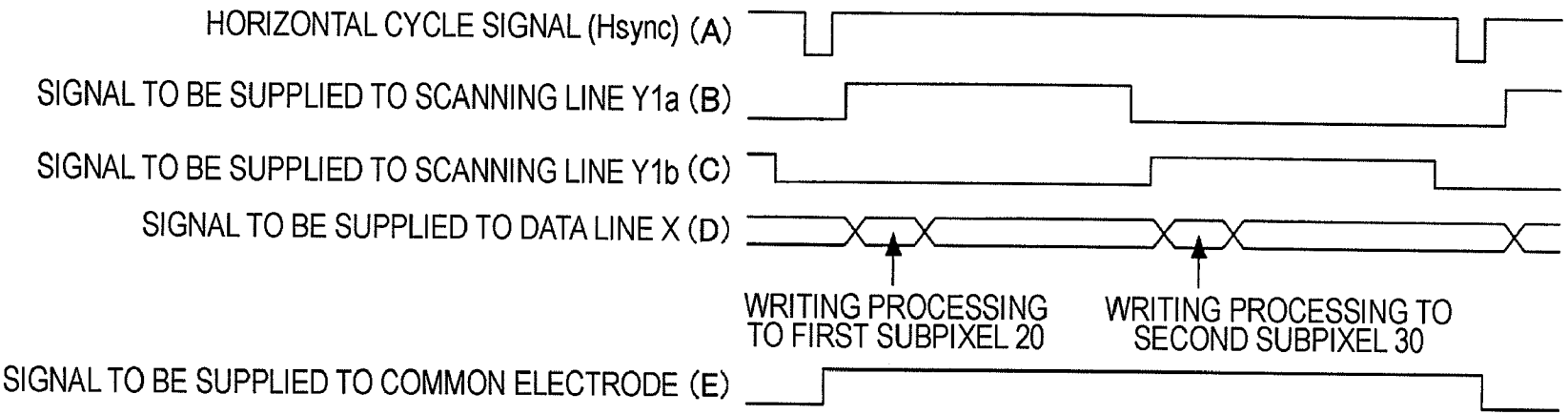
FIG. 4 shows a waveform chart illustrating a timing of selecting one of a plurality of scanning lines, a timing of outputting data to be supplied to one of a plurality of data lines, and a timing of switching a voltage to be applied to a common electrode.

As shown in FIG. 4, the scanning line driving circuit 40 successively switches between the scanning line Y1*a* and the scanning line Y1*b* connected to the first subpixel 20 and the second subpixel 30, respectively, which are a pair of scanning lines constituting one pixel, in a predetermined timing in one horizontal scanning period in accordance with a result of the determination made using the determination unit 44.

The data line driving circuit 42 modulates the image signals to be supplied to the data lines X so that pulse-surface-area modulation is performed in low-gray-scale-level display and high-gray-scale-level display entirely in each of the pixels constituted by pairs of pixel electrodes ((D) of FIG. 4). The modulated image signals are supplied to the data lines X.

For example, if a detected gray-scale level is "64", an image signal is modulated so that the first subpixel 20 performs display with a gray-scale level of "0" and the second subpixel 30 performs display with a gray-scale level of "192". As described above, since the pulse-surface-area modulation is performed, a response speed is improved while the entire pixel performs display with a gray-scale level of "64". Note that, in this example, the response speed is 44 msec.

On the other hand, in a case where it is determined that a gray-scale level, which is detected using the gray-scale-level detection unit 43 which is controlled by the determination unit 44, is out of a range considered to be a halftone, that is, it is determined that the detected gray-scale level is a low gray-scale level or a high-gray-scale level, for example, the image signal may be modulated so that the first subpixel 20 and the second subpixel 30 perform display with the same gray-scale level. Alternatively, one of the pixel electrodes included in the first subpixel 20 and the second subpixel 30 may be controlled so as not to be driven.

As described above, since the electro-optical device 1 according to the embodiment of the invention causes each of the pixels to perform display using a pair of subpixels, halftone display is achieved without performing overdrive processing. Accordingly, since a memory necessary for the overdrive processing can be eliminated, a size of the entire device and production cost thereof can be reduced, and a response speed of the liquid crystal can be improved. Furthermore, the amount of electric power required for the overdrive processing can be reduced.

Note that the first subpixel 20 and the second subpixel 30 may be configured in a different area ratio.

Second Embodiment

Figure 5:
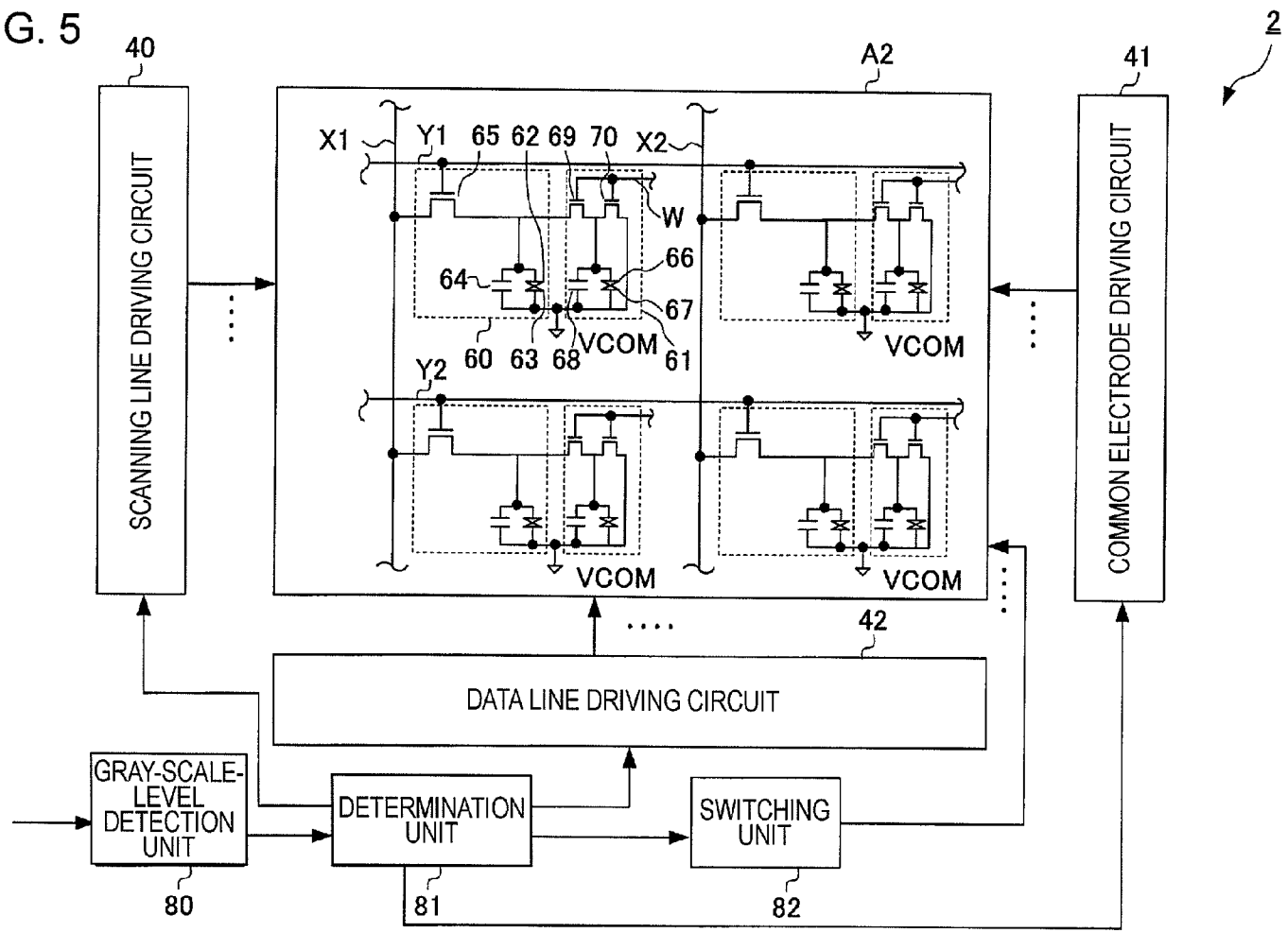
FIG. 5 shows a block diagram illustrating an example of a second configuration of the electro-optical device according to another embodiment of the invention.

A second embodiment according to the invention will now be described. As shown in FIG. 5, an electro-optical device 2 includes a pixel unit A2, a scanning line driving circuit 40, common electrodes 63 and 67, a common electrode driving circuit 41, a data line driving circuit 42, a gray-scale-level detection unit 80, a determination unit 81, and a switching unit 82. The pixel unit A2 is a display area including a plurality of pixels. The scanning line driving circuit 40 selectively drives the plurality of scanning lines Y in a predetermined order. The common electrode driving circuit 41 supplies voltages to be applied to the common electrodes 63 and 67. The data line driving circuit 42 supplies image signals to the data lines X when one of the scanning lines Y is selected. The gray-scale-level detection unit 80 detects a gray-scale level of each of the image signal. The determination unit 81 determines whether the gray-scale level detected using the gray-scale-level detection unit 43 is within a range considered to be a halftone. The switching unit 82 switches switching devices. The determination unit 81 also functions as a timing controller. The electro-optical device 2 further includes a backlight unit, not shown, which illuminates the pixel unit A2 from the back side thereof. Note that only a portion (four pixels) of the pixel unit A2 is shown in FIG. 5.

Here, a configuration of the pixel unit A2 will be described in detail. Note that each of the pixels according to the embodiment of the invention includes at least two adjacent subpixels as a group. Description will be made hereinafter for each of the pixels including two subpixels, that is, a first subpixel 60 and a second subpixel 61.

The first subpixel 60 includes, as shown in FIG. 5, a pixel electrode 62, a common electrode 63 arranged so as to face the pixel electrode 62, a storage capacitor 64, and a switching device 65 (for example, TFT (thin-film transistor)) used for electrically connecting the pixel electrode 62 to corresponding one of the data lines X in accordance with a selection voltage supplied from a corresponding one of the scanning lines Y. Note that in this embodiment, although a TFT is taken as an example of the switching device, the invention is not limited to this. A TFD (thin-film diode) may be used as the switching device.

The first switching device 65 is connected to the pixel electrode 62 through a first terminal (a source terminal or a drain terminal), is connected to a scanning line Y1 through a second terminal (a gate terminal), and is connected to a data line X1 through a third terminal (a drain terminal or a source terminal).

The second subpixel 61 includes, as shown in FIG. 5, a pixel electrode 66, a common electrode 67 arranged so as to face the pixel electrode 66, a storage capacitor 68, a second switching device 69 used for electrically connecting the pixel electrode 66 to the first switching device 65 in accordance with a selection voltage supplied from a corresponding one of the scanning lines Y, and a third switching device 70 used for electrically connecting the pixel electrode 66 to the common electrode 67. Note that the common electrode 63 and the common electrode 67 are integrally configured.

The second switching device 69 is connected to the pixel electrode 66 through a first terminal (a source terminal or a drain terminal), is connected to a corresponding one of the control lines W through a second terminal (a gate terminal), and is connected to the first terminal of the first switching device 65 through a third terminal (a drain terminal or a source terminal).

The third switching device 70 is connected to the pixel electrode 66 through a first terminal (a source terminal or a drain terminal), is connected to a corresponding one of the control lines W through a second terminal (a gate terminal), and is connected to the common electrode 67 through a third terminal (a drain terminal or a source terminal).

Accordingly, for example, switching between the second switching device 69 and the third switching device 70 is selectively performed so that low-gray-scale-level display is achieved using the first subpixel 60 and high gray-scale-level display is achieved using the second subpixel 61 whereby pulse-surface-area modulation is performed and halftone display is achieved.

The gray-scale-level detection unit 80 detects gray-scale levels of input image signals and supplies results of the detection to the determination unit 81. Note that in this embodiment, although the gray-scale-level detection unit 80 detects gray-scale levels of the image signals in 256 gray-scale levels, the present invention is not limited to this.

The determination unit 81 determines, for each of the gray-scale levels of the image signals supplied from the gray-scale-level detection unit 80, whether the gray-scale level is within a predetermined range (for example, a range from 64 to 128) considered to be a halftone.

The switching unit 82 controls the second switching device 69 and the third switching device 70 to be turned on or off in accordance with a result of the determination output from the determination unit 81.

Specifically, in a case where the determination unit 81 determines that a gray-scale level detected using the gray-scale-level detection unit 80 is within the predetermined range considered to be a halftone, the switching unit 82 supplies a first switching signal to the corresponding one of the control lines W so that the second switching device 69 is turned off and the third switching device 70 is turned on in one horizontal scanning period. On the other hand, in a case where the determination unit 81 determines that a gray-scale level detected using the gray-scale-level detection unit 80 is out of the predetermined range considered to be a halftone, the switching unit 82 supplies a second switching signal to the corresponding one of the control lines W so that the second switching device 69 is turned on and the third switching device 70 is turned off in one horizontal scanning period.

The second switching device 69 is formed of an N-channel transistor and the third switching device 70 is formed of a P-channel transistor. Accordingly, when a low-level signal is supplied as the first switching signal to the corresponding one of the control lines W, the second switching device 69 is turned off whereas the third switching device 70 is turned on. On the other hand, when a high-level signal is supplied as the first switching signal to the corresponding one of the control lines W, the second switching device 69 is turned on whereas the third switching device 70 is turned off. The second switching device 69 may be formed of a P-channel transistor and the third switching device 70 may be formed of an N-channel transistor.

Figure 6:
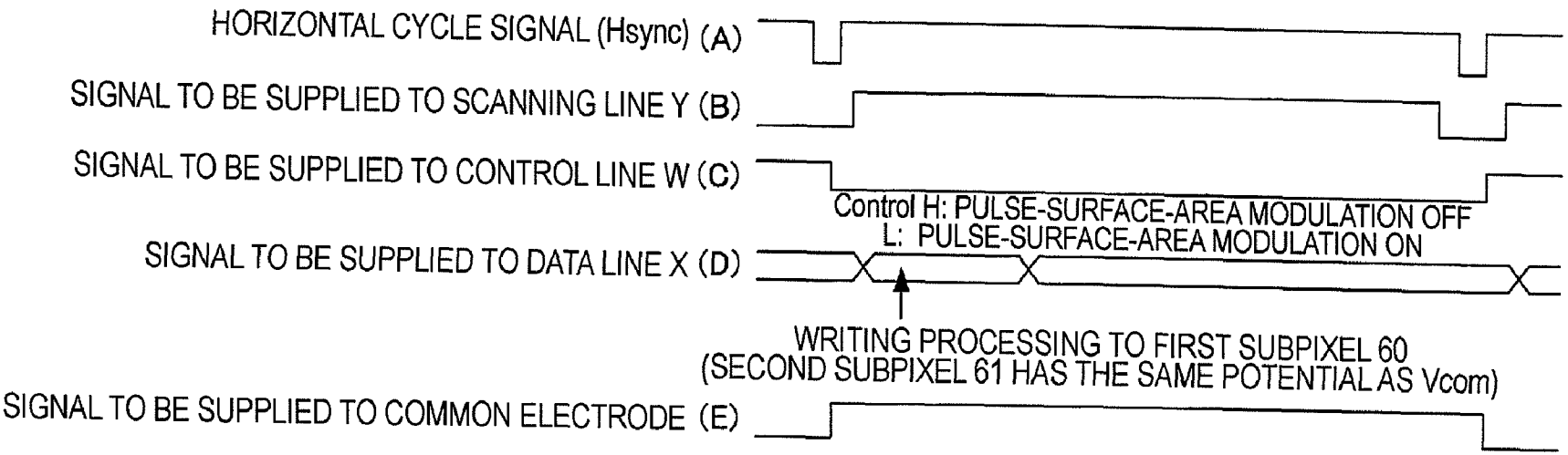
FIG. 6 shows a waveform chart illustrating a timing of turning on/off one of a plurality of scanning lines in one horizontal scanning period, a timing of supplying a switching signal to one of a plurality of control lines, a timing of outputting data to be supplied to the one of the plurality of data lines, and a timing of switching a voltage to be applied to the common electrode.

Referring to FIG. 6, a switching operation performed using the switching unit 82 in a case where the determination unit 81 determines that a gray-scale level detected using the gray-scale-level detection unit 80 is within the predetermined range considered to be a halftone, and in a case where the determination unit 81 determines that a gray-scale level detected using the gray-scale-level detection unit 80 is out of the predetermined range considered to be a halftone will be described. FIG. 6 shows a waveform chart illustrating a timing of turning on/off one of the scanning lines Y in one horizontal scanning period, a timing of supplying a switching signal to one of the control lines W, a timing of outputting data to be supplied to one of the data lines X, and a timing of switching a voltage to be applied to the common electrodes 63 and 67. Note that the voltage (Vcom) to be applied to the common electrodes 63 and 67 are inversed every horizontal synchronization signal.

In a case where the determination unit 81 determines that the gray-scale level detected using the gray-scale-level detection unit 80 is within the predetermined range considered to be a halftone, that is, it is determined that the detected gray-scale level is an intermediate gray-scale level, the switching unit 82 supplies a first switching signal to corresponding one of the control lines W so that the second switching device 69 is turned off and the third switching device 70 is turned on whereby pulse-surface-area modulation is performed. The second subpixel 61 has potentials at both ends the same as those applied to the common electrodes 63 and 67 resulting in no voltage being applied to the second subpixel 61. On the other hand, in the first subpixel 60, a predetermined potential is applied to the liquid crystal in accordance with a voltage supplied from the corresponding one of the data lines X through the first switching device 65. Accordingly, halftone display is realized by pulse-surface-area modulation using the first subpixel 60 and the second subpixel 61.

On the other hand, in a case where the determination unit 81 determines that the gray-scale level detected using the gray-scale-level detection unit 80 is out of the predetermined range considered to be a halftone, that is, it is determined that the detected gray-scale level is a low gray-scale level or a high-gray-scale level, since it is not necessary to perform pulse-surface-area modulation, the switching unit 82 supplies a second switching signal to the corresponding one of the control lines W so that the second switching device 69 is turned on and the third switching device 70 is turned off. Accordingly, since the same potentials are applied to the first subpixel 60 and the second subpixel 61, normal gray-scale display is performed.

As described above, since the electro-optical device 2 according to the embodiment of the invention causes each of the pixels to perform display using the first subpixel 60 and the second subpixel 61, halftone display is achieved without performing overdrive processing. Accordingly, since a memory necessary for the overdrive processing can be eliminated, a size of the entire device and production cost thereof can be reduced, and a response speed of the liquid crystal can be improved. Furthermore, the amount of electric power required for the overdrive processing can be reduced.

Note that the first subpixel 60 and the second subpixel 61 may be configured in a different area ratio.

In the above-described first and second embodiments, although each of the pixels is constituted by two subpixels, the present invention is not limited to this. Alternatively, each of the pixels may be constituted by three or more subpixels. Furthermore, image signals may be supplied to subpixels at the same time or at different times. Moreover, in the above-described first and second embodiments, although an MVA method is employed as an example of a method for driving the liquid crystal, an ECB (electrically controlled birefringence) method may be employed. Here, the ECB method is a method in which a voltage to be applied to a liquid crystal layer is changed to change orientation of liquid crystal molecules, and change of birefringent property of the liquid crystal layer which occurs as a result of the change of the orientation of the liquid crystal molecules is detected using a pair of polarizing plates. The ECB method is applied to color display.

Application

Figure 7:
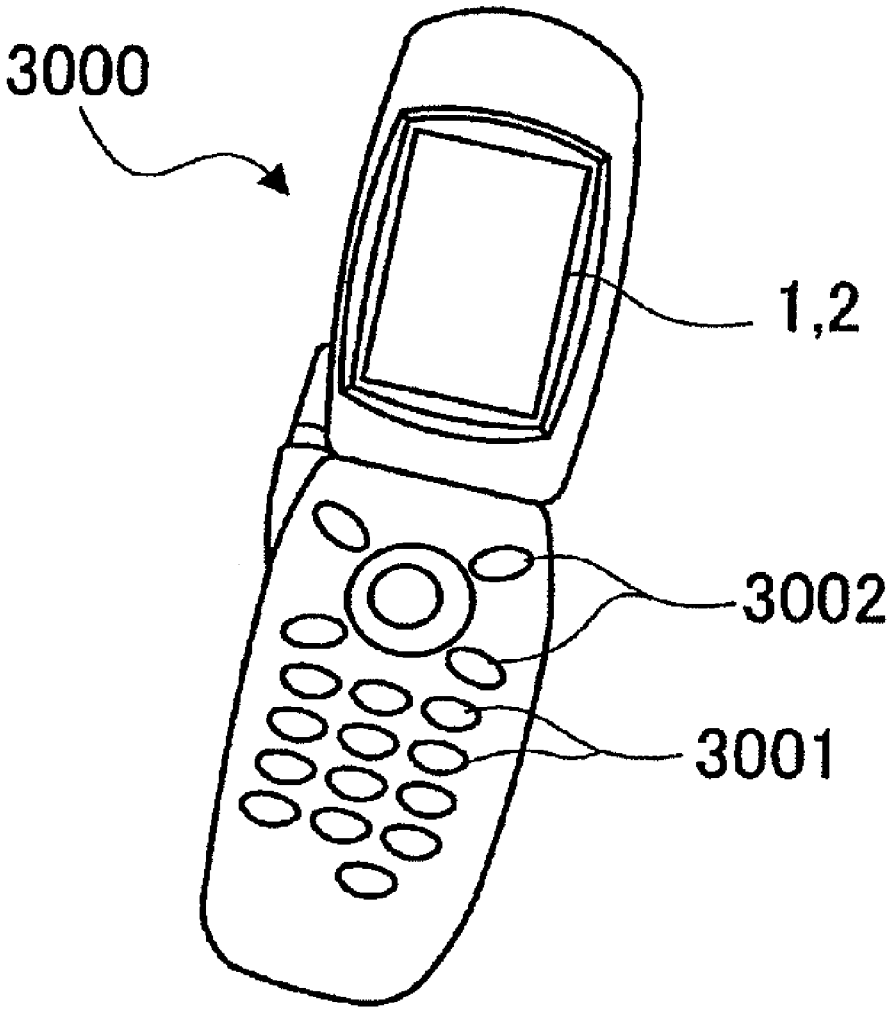
FIG. 7 shows a perspective view illustrating a configuration of a cellular phone to which the electro-optical device is applied.
Figure 8A:
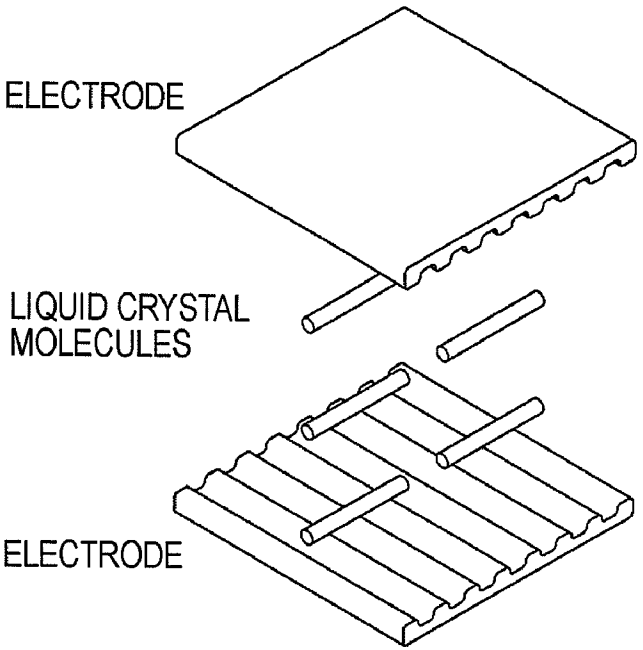
FIG. 8 shows a schematic view illustrating an alignment of liquid crystal molecules in a VA method.
Figure 8B:
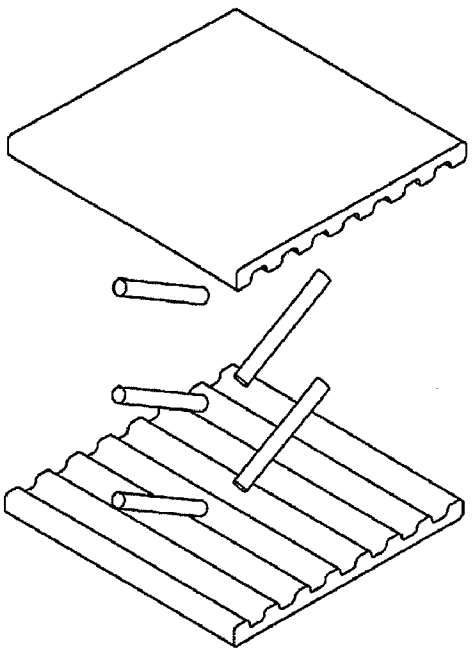
Figure 8C:
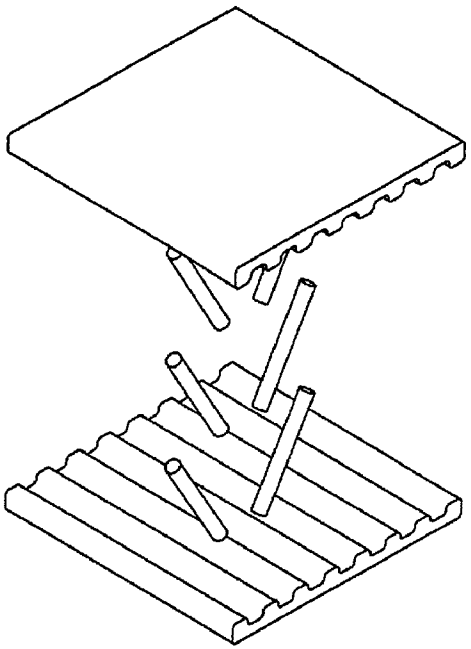

An electronic apparatus to which the electro-optical device 1 or 2 according to the above-described embodiments is applied will be described. FIG. 7 shows a perspective view illustrating a configuration of a cellular phone to which the electro-optical device 1 or 2 is applied. A cellular phone 3000 includes a plurality of operation buttons 3001, a scroll button 3002, and the electro-optical device 1 or 2. A screen displayed on the electro-optical device 1 or 2 is scrolled by operating the scroll button 3002.

Examples of such an electronic apparatus to which the electro-optical device 1 or 2 is applicable include, in addition to the apparatus shown in FIG. 7, a personal computer, a handheld terminal, a digital still camera, a liquid crystal display television set, a video-tape recorder having a viewfinder or a monitor directly viewed by a user, a car navigation apparatus, a pager, an electronic notebook, a calculator, a word processor, a workstation, a video telephone, a POS (point of sales) terminal, and an apparatus having a touch panel. The electro-optical device described above is applicable as a display unit to these electronic apparatuses.

The entire disclosure of Japanese Patent Application No. 2006-216511, filed Aug. 9, 2006 is expressly incorporated by reference herein.

What is claimed is:

1. An electro-optical device comprising:

a plurality of scanning lines and a plurality of data lines;

pixels arranged so as to correspond to intersections of the plurality of scanning lines and the plurality of data lines; and an electro-optical material in which a response speed at a time of changing to halftone display is lower than those at a time of changing to low-gray-scale-level display and at a time of changing to high-gray-scale-level display, wherein each of the pixels includes at least two adjacent subpixels as a group, each of the subpixels including a pixel electrode, a common electrode arranged so as to face the pixel electrode, and a switching device which electrically connects a corresponding one of the data lines to the pixel electrode in accordance with a selection voltage supplied from a corresponding one of the scanning lines, the switching device being connected to the corresponding one of the scanning lines.

2. The electro-optical device according to claim 1, further comprising:

a gray-scale-level detection unit that detects a gray-scale level of image data externally supplied;

a determination unit that determines whether the gray-scale level detected using the gray-scale-level detection unit is within a range considered to be a halftone;

a scanning line driving circuit that generates the selection voltage used for sequentially selecting the plurality of scanning lines in a predetermined order in accordance with a result of the determination made using the determination unit, and supplies the selection voltage to the corresponding one of the scanning lines; and a data line driving circuit that generates a certain image signal from the image data in accordance with the result of the determination made using the determination unit, and supplies the generated image signal to the corresponding one of the data lines, wherein, when the determination unit determines that the gray-scale level is within the range considered to be a halftone, the scanning line driving circuit generates the selection voltage used for sequentially selecting the plurality of scanning lines each of which is connected to a corresponding switching device in one horizontal scanning period, and supplies the generated selection voltage to the corresponding one of the scanning line, and the data line driving circuit generates an image signal used for low-gray-scale-level display and an image signal used for high-gray-scale-level display so that halftone display is entirely achieved in each of the pixels, and supplies the generated image signals to the corresponding data lines at a predetermined timing.

3. An electro-optical device comprising:

a plurality of scanning lines and a plurality of data lines;

pixels arranged so as to correspond to intersections of the plurality of scanning lines and the plurality of data lines; and an electro-optical material in which a response speed at a time of changing to halftone display is lower than those at a time of changing to low-gray-scale-level display and at a time of changing to high-gray-scale-level display, wherein each of the pixels includes a pair of a first subpixel and a second subpixel arranged adjacent to each other, the first subpixel including a first pixel electrode, a common electrode arranged so as to face the first pixel electrode, and a first switching device which electrically connects the corresponding one of the data lines to the first pixel electrode in accordance with a selection voltage supplied from the corresponding one of the scanning lines, the second subpixel including a second pixel electrode, the common electrode arranged so as to face the second pixel electrode, a second switching device which is connected to the first pixel electrode and the second pixel electrode, and a third switching device which is connected to the common electrode and the second pixel electrode, the second switching device and the third switching device being commonly connected to a control line so as to be switched between a on-state and a off-state.

4. The electro-optical device according to claim 3, further comprising:

a gray-scale-level detection unit that detects a gray-scale level of image data externally supplied;

a determination unit that determines whether the gray-scale level detected using the gray-scale-level detection unit is within a range considered to be a halftone;

a scanning line driving circuit that generates the selection voltage used for sequentially selecting the plurality of scanning lines in a predetermined order, and supplies the selection voltage to the corresponding one of the scanning lines;

a data line driving circuit that generates a certain image signal from the image data in accordance with a result of the determination made using the determination unit, and supplies the generated image signal to the corresponding one of the data lines; and a switching unit that turns off the second switching device and turns on the third switching device in one horizontal scanning period when the determination unit determines that the gray-scale level is within the range considered to be a halftone, and that turns on the second switching device and turns off the third switching device in one horizontal scanning period when the determination unit determines that the gray-scale level is out of the range considered to be a halftone, wherein, when the switching unit turns off the second switching device and turns on the third switching device, the data line driving circuit supplies an image signal for low-gray-scale-level display to one of the first subpixel and the second subpixel and supplies an image signal for high-gray-scale-level display to the other one of the first subpixel and the second subpixel through the corresponding data lines so that halftone display is entirely achieved in each of the pixels including the first subpixel and the second subpixel.

5. An electronic apparatus including the electro-optical device set forth in claim 1.

* * * * *